United States Patent [19]

Schrotz et al.

[11] 4,288,276

[45] Sep. 8, 1981

[54] HAND-HELD LABEL PRINTING, DISPENSING AND APPLYING APPARATUS

[75] Inventors: Kurt Schrotz; Werner Becker, both of Hirschhorn, Fed. Rep. of Germany

[73] Assignee: Esselte Pendaflex Corporation, Garden City, N.Y.

[21] Appl. No.: 50,427

[22] Filed: Jun. 20, 1979

[51] Int. Cl.[3] ..... B65C 11/02

[52] U.S. Cl. ..... 156/384; 101/288; 156/541; 156/577; 156/579; 156/584; 156/DIG. 49

[58] Field of Search ..... 156/384, 541, 577, 579, 156/584, 523, DIG. 48, DIG. 49; 101/287, 288

[56] References Cited

U.S. PATENT DOCUMENTS

| | | | |
|---|---|---|---|
| 3,902,952 | 9/1975 | Penaluna | 156/384 |
| 3,969,181 | 7/1976 | Seabold | 156/577 |
| 4,059,476 | 11/1977 | Hamisch, Jr. | 156/384 |
| 4,188,255 | 2/1980 | Gottard | 156/384 |

FOREIGN PATENT DOCUMENTS

| | | |
|---|---|---|
| 2530940 | 2/1976 | Fed. Rep. of Germany . |
| 2638441 | 11/1977 | Fed. Rep. of Germany . |

*Primary Examiner*—Michael G. Wityshyn
*Attorney, Agent, or Firm*—Gerald J. Ferguson, Jr.; Joseph J. Baker

[57] ABSTRACT

A hand-held labelling apparatus for printing, dispensing and applying self-adhering labels, having a housing provided with a handle and having two side walls consisting of sheet metal and held in spaced relation.

Each side wall of the said housing comprises two parallel and free edges which are opposite one another.

Casing or sheathing walls consisting of synthetic plastics are capable of being pushed over the outsides of each side wall. The said casing walls comprise flanges which engage over the free edges of the side walls.

14 Claims, 6 Drawing Figures

HAND-HELD LABEL PRINTING, DISPENSING AND APPLYING APPARATUS

BACKGROUND OF THE INVENTION

The invention relates to a hand-held label printing and applying apparatus, by which self-adhering labels are successively printed and applied to merchandise. The apparatus comprises a metal housing which, seen from the side, is substantially in the form of a rectangle, trapezium or parallelogram and is provided with a handle, the side walls of said housing, advantageously consisting of sheet steel and held in spaced relation, having arranged between them a printing unit. a withdrawal device for a carrier strip feeding the labels, a deflecting device for the carrier strip and a pressure-applying device for the label which is in the dispensing position and which is at least partially detached from the carrier strip.

Apparatus of this type are, for example, known from U.S. Pat. No. 3,265,553.

The disadvantage which exists with the known hand-held labelling apparatus is that the housing of the appliance is provided with a handle and has to satisfy several different standards of technical, economic and aesthetic type, the common fulfillment of which is not to be achieved or only at great expense. The housing is to be strong and dimensionally rigid, so as to protect the devices fitted into the housing against damage and to enable a precise accommodation, fixing or mounting of these parts in the housing. The housing is to be light, so that the weight of the appliance is kept low. The side walls of the housing, advantageously consisting of steel plates, are to be formed with openings for receiving spacer pins, pivot shafts for a handle, a rocking inking mechanism or the like and pivots, for example, for the mounting of a winding drum from which the carrier strip is unwound and a freely rotatable pressure-applying roller for rolling on the respectively dispensed label. For reasons of expense, the side walls of the housing are to be produced as far as possible by simple stamping. The outside of the apparatus is to be of pleasing appearance, have no sharp edges and have a smoothest possible surface, so that the apparatus can be kept clean.

SUMMARY OF THE INVENTION

It is a general object of the present invention to avoid the disadvantages of the prior art hand-held labelling apparatus.

More particularly, it is an object of the present invention to provide a hand-held labelling apparatus, with which the conditions as mentioned before can be satisfied in a particularly economic manner.

This object is achieved according to the invention by each side wall of the metal housing comprising two parallel and free edges opposite one another and by casing walls consisting of synthetic plastics material being capable of being pushed over the outsides of each side wall, said casing walls comprising flanges which engage over the free edges of the side walls.

The labelling apparatus according to the invention has the advantage that the side walls of the housing are sheet metal of steel components, which do not require any further machining. For reinforcement purposes, the sheet steel side walls may be provided with fins and have relatively large openings, which serve firstly for saving weight, but secondly also serve as openings for fitting purposes. These fitting openings become readily accessible by displacement of the casing walls, for example, so as to have better access to the label-guiding passage or in order to obviate defects on the printing unit or on a inking device or in order to replace an inking pad on the inking device.

The casing walls made of synthetic plastics material which can be pushed on to the appliance have the additional advantage that, because of their elasticity, they provide better protection to the apparatus against damage due to knocks and provide a better cushioning action against impact when an appliance falls on to a hard floor. The said casing walls have the additional advantage that they serve to protect the screws with which one side wall is screwed on to the spacer pins.

It is particularly advantageous if the two casing walls are connected to one another in one piece through a casing which covers the handle and these casing walls, with the casing covering the handle, are capable of being pushed on to the side walls longitudinally of the apparatus. The casing walls and the handle casing can be held in their position for use on the housing by a resilient latch. By releasing this latch, the casing walls and the handle casing can be removed from the housing. It is possible in this way for an apparatus which is intact on its outside, but is disfigured because of damage and is dirty, to be made as good as new by pushing on a new casing.

The one-piece synthetic plastic casing which forms the two casing walls and the handle part and can easily be pushed on determines the appearance of the labelling apparatus according to the invention. This synthetic plastic casing engages over the two side walls of the housing, preferably at their longitudinal edges, so that this casing is securely held on the housing merely by means of a latch. The casing, which is formed as an injection-moulded plastic component, has substantially smooth surfaces, which are strongly rounded at the corners. In the region of the handle, the plastic casing or the handle casing is so formed that it provides a handle device lying comfortably in the hand. The handle casing is supported on the handle connected to the housing by means of fins extending perpendicularly of its walls, so that, between the fins, the handle casing does not touch the handle, so that the handle connected fast to the housing may be given a very simple form, while the handle casing has a shape which tapers towards the rear and the side walls and the upper wall of the handle casing are slightly arched and the side walls merge with a strong rounding effect into the top side of the handle casing.

Since the plastic casing can be easily replaced, it may be made in different colours and also in different designs. Furthermore, without having to make any changes in construction, it is possible to adapt the hand-held labelling apparatus to large hands or even also to small hands by puhsing on a plastic casing having a handle casing of different shape.

Other features of the invention will be apparent from the claims. One constructional example of the invention is hereinafter more fully explained in the following description.

DESCRIPTION OF PREFERRED EMBODIMENTS

Figure 1:
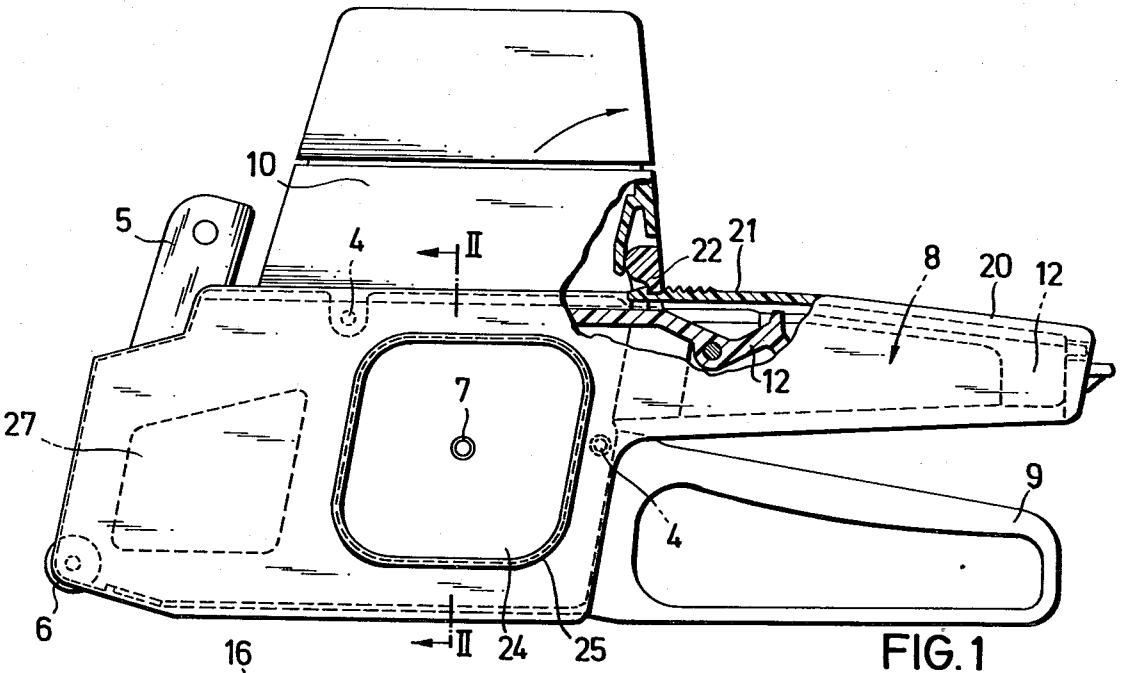
FIG. 1 is a side elevation of the hand-held labelling apparatus according to the invention, partly in section.
Figure 3:
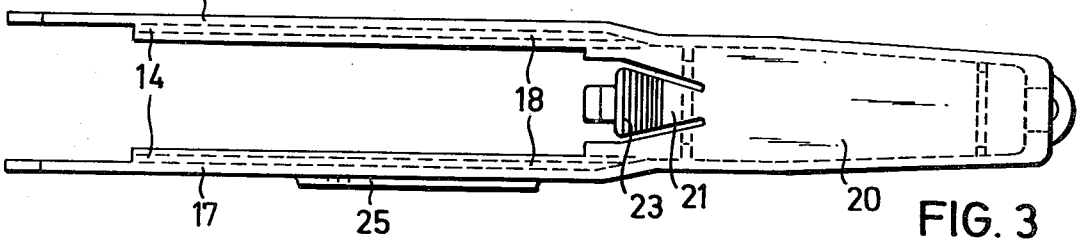
FIG. 3 is a plan view of a casing of synthetic plastics material which can be pushed on to the housing.
Figure 2:
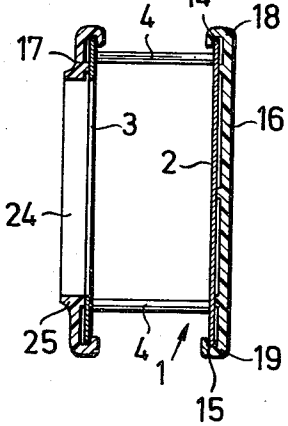
FIG. 2 is a view along the section line II—II in FIG. 1.

Referring now th the drawings and first to FIG. 1 thereof, it may be seen that a hand-held label marking apparatus comprises a housing 1 with a right-hand side wall 2 and a left-hand side wall 3 and spacer pins 4, which hold the two side walls in spaced relation. Arranged in the housing 1 is a printing unit 5, a pressure device 6 in the form of a pressure-applying roller and a withdrawal device for the label carrier strip and in the form of a withdrawal roller. The withdrawal roller is rotatably and removably mounted on a shaft 7, which is held at one end by the right-hand side wall 2 of the housing 1. Arranged on the housing 1 diagonally opposite the pressure device 6 is a handle 8, against which is adapted to be swung a hand lever 9 which is mounted for pivotal movement in the housing 1 about a spacer pin 4. The hand lever 9 is held by a spring in the open position. By the hand lever 9 being swung in or out, the printing unit 5 for printing a label is actuated and also the withdrawal device for the carrier strip for the feeding of a label is set in operation.

Arranged above the housing 1 is a label-storage container 10, which accommodated a supply roll of labels and is pivotally connected to the housing 1 on the pivot shaft 11.

Figure 6:
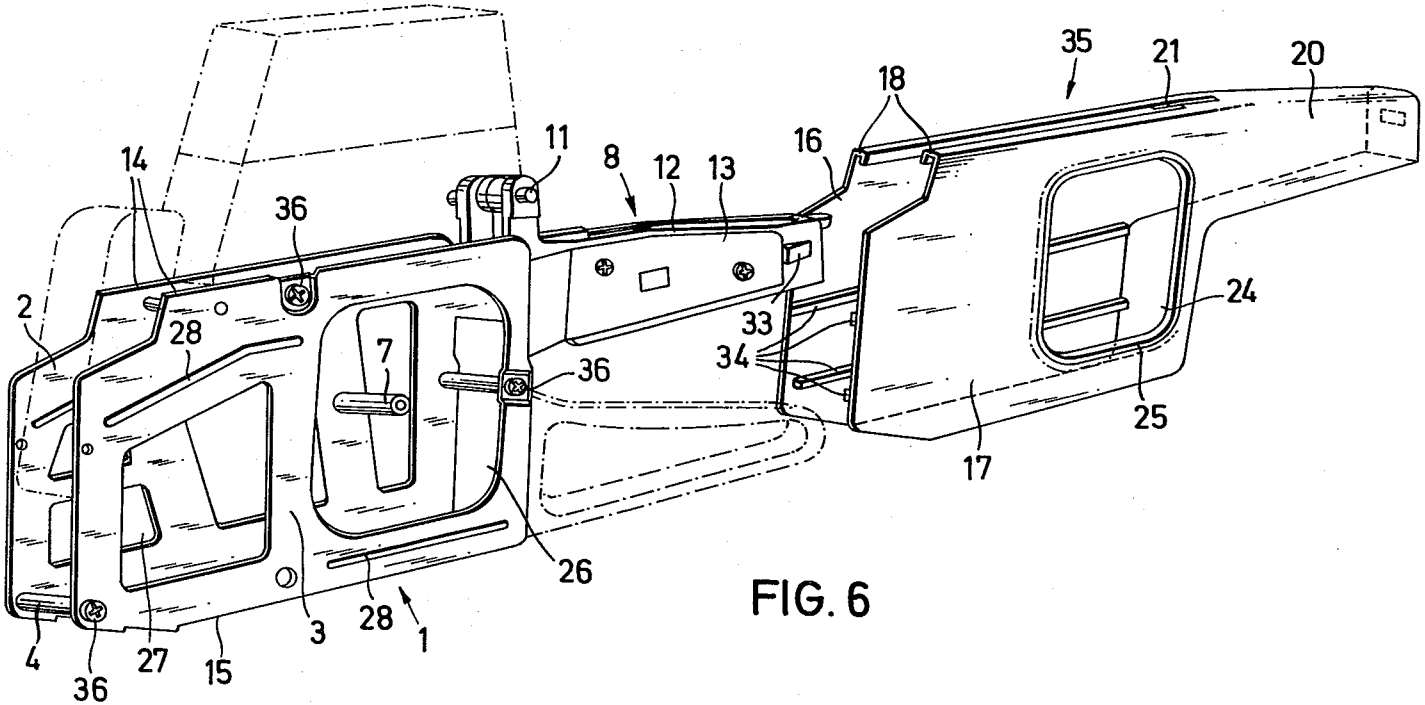
FIG. 6 is a perspective view of the housing with a rigidly connected handle and the plastic casing which can be pushed on to the housing.

As shown more particularly by FIG. 6, the side walls 2 and 3 of the housing 1 are stamped steel parts, which are connected through spacer pins 4 and a reinforcing body 12 consisting of synthetic plastics to form a unit. The reinforcing body 12, in association with sheet metal walls 13, which are connected to the side walls 2 and 3 in one piece, forms a rigid handle. As shown in FIG. 6, large openings 26 and 27 are stamped in the two side walls 2 and 3 of the housing 1, these openings firstly serving for reducing the weight, bus secondly also providing large openings for fitting purposes, which make possible easy access to the devices arranged in the housing 1.

The side walls 2 and 3 comprise parallel free edges 14 and 15 which are opposite one another, so that a casing wall 16 and 17 consisting of synthetic plastics is capable of being pushed over the outsides of each side wall 2,3. The plastic casing walls 16,17 comprise inwardly directed flanges 18 and 19 at their bottom and top edges, said flanges engaging around the free edges 14 and 15 of the side walls 2 and 3. The two casing walls 16 and 17 are connected to one another to form a single unit by means of a handle casing 20 which encloses the handle 8. As shown in FIG. 6, the two casing walls 16 and 17 and the handle casing 20 forms a one-piece plastic casing 35, which is capable of being pushed on to the side walls 2 and 3 of the housing 1 longitudinally of the apparatus. It is also possible to visualise a modified constructional form, with which the two casing walls or the synthetic plastic casing 35 can be pushed from above on to the housing 1 and with which the substantially vertically extending dges of the side walls 2 and 3 are parallel to one another and are free, so that it is possible for correspondingly extending flanges of the casing walls or of the plastic casing 35 to engage around them.

The plastic casing 35 comprises on the forward end of the upper side of the handle casing 20 a resilient latch 21 which, as the plastic casing 35 is pushed on, engages between a latch stop 22 (see FIG. 1), which is rigidly connected to the housing 1. In this way, the plastic casing 35 is held in the position for use, as shown in FIG. 1.

Figure 4:
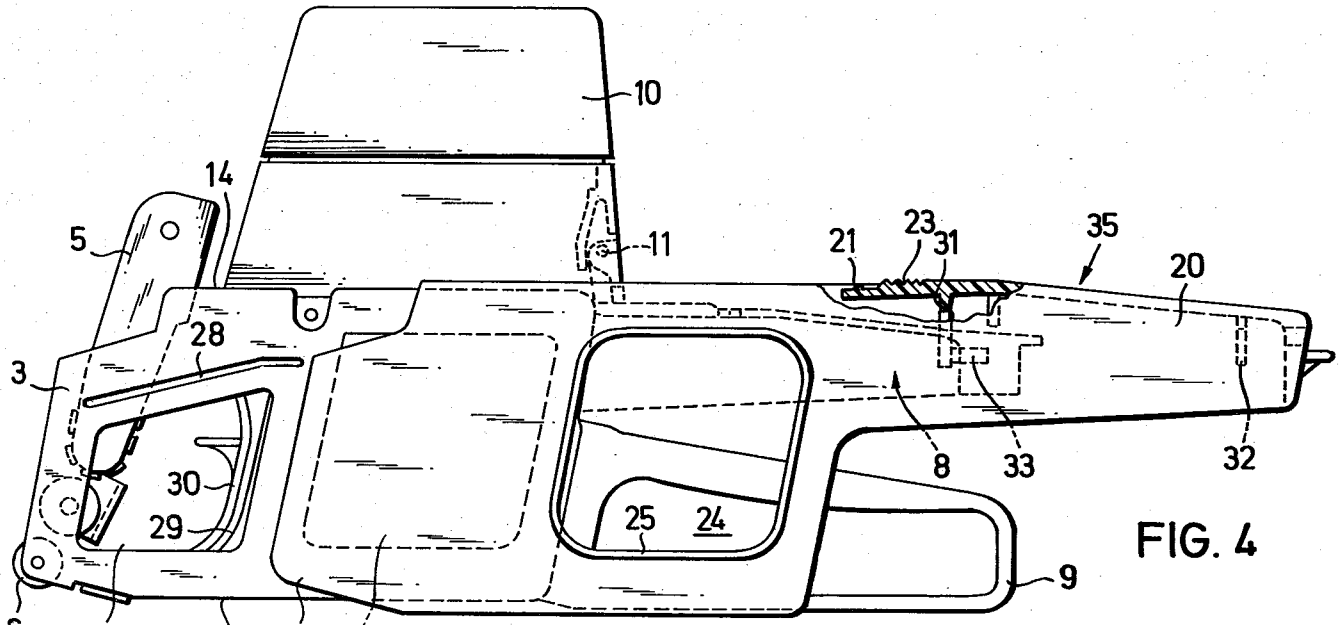
FIG. 4 is a side elevation corresponding to FIG. 1, with the plastic casing withdrawn.

Provided on the upper side of the latching tongue 21 is a fluting 23. By pressing down the latching tongue 21, the plastic casing 35 can be retracted to the position shown in FIGS. 4 and 5, so that the opening 27 for fitting purposes is uncovered and as a result it is possible to have access to positions in the appliance at which disruptions may occur. In FIG. 4, a label-guiding passage 29 is visible in the fitting opening 27 which passage becomes accessible for cleaning purposes by removing or swinging up a strip-guiding wall 30. The possibility of access to those parts of the appliance liable to be soiled is in this way also improved by comparison with the known hand-labelling appliances. The handling of the appliance for cleaning purposes is also very much easier, since no wall sections have to be removed of hinged up with wall sections connected to the housing. Such hinged wall sections are frequently a nuisance at the time of cleaning an apparatus.

Figure 5:
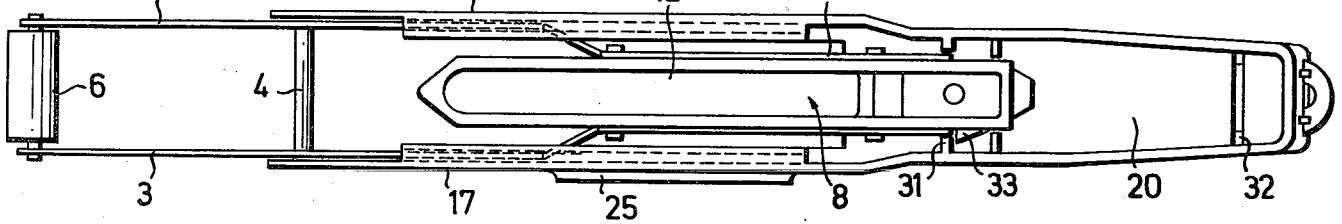
FIG. 5 is an underneath view of the apparatus shown in FIG. 4.

As shown in FIG. 5, the handle casing 20 is supported against the handle 8 by means of webs or bars 31,32 extending at right angles to the lateral walls and the top wall of the casing 20. A free space remains between the handle 8 and the walls of the handle casing 20, so that the latter may be designed in such a way that it lies as comfortably as possible in the hand. Accordingly, plastic casings 35 for pushing on to the apparatus may be given different shapes, some of which are intended for relatively large hands and some for smaller hands.

An opening 27 for fitting or assembly purposes is arranged in at least one side wall 3 of the housing 1 and the casing walls 16,17 or the plastic casing 35 are guided on the housing 1 so that they can be displaced as far as a stop 33 by pressing down the latching tongue 21, in order to expose the said opening.

The stop 33 is arranged on the handle 8 rigidly connected to the housing 1 or on the reinforcing body 12 which is made of synthetic plastics material and bears against the forward bar 31 of the handle casing 20 when the casing wall 17 or the plastic casing 35 is in the open position.

In connection with a hand-held labelling apparatus with which the withdrawal device for the label carrier strip is unwound from a winding drum which can be intermittently driven and is rotatable about the shaft 7, it is advantageous if a large recess 26 is arranged in the side wall 3 of the housing 1 and a correspondingly large opening 24 is arranged in the associated casing wall 17. The recess 26 and also the opening 24 serve to enable the winding drum with the reeled carrier strip to be easily removed from the labelling apparatus. The rim of the opening 24 is preferably reinforced by an outwardly projecting frame 25 which is formed on the casing wall 17.

In order to stiffen the side walls 2 and 3 of the housing, outwardly projecting fins 28 are stamped into the said walls. Furthermore, inwardly projecting beads 34 are formed on the casing walls 16 and 17. By means of the fins 28, firstly the housing 1 is reinforced and secondly the result is obtained that the casing walls 16 and 17 do not bear over the entire surface against the side walls 2 and 3 of the housing 1. This has the effect that a gap-like space remains free between the side walls 2 and 3 of the housing 1 and the casing walls 16 and 17, the effect thereof being firstly that the manufacturing tolerances for the synthetic plastic casting 35 can be chosen to be relatively large, and secondly the casing walls 16 and 17 are able to have a springing action with respect to the side walls 2 and 3 of the housing 1.

As shown more particularly by FIG. 6, the plastic casing 35 has the effect that all screws 36, with which the side wall 3 of the housing 1 is screwed on to the spacer pins 4 are covered and thus are also protected. The yieldable latching tongue 21 arranged in the upper part of the plastic casing 35 on the extension of the casing handle 20 is so designed that it automatically latches when the plastic casing 35 is pushed on. The plastic casing 35 is unlatched by pressing down on the latching tongue 21, so that it can be retracted as far as the stop 33, so as, for example, to expose the fitting opening 27. The stop 33 is arranged in a concealed position, so that only the expert is able to overcome the said stop by slightly bending up one side wall of the handle casing 20. In this way, the inexperienced person is prevented from removing the plastic casing 35 completely from the labelling apparatus.

What is claimed as new and desired to be protected by Letters Patent is set forth in the appended claims:

1. A hand-held labelling apparatus for printing, dispensing and applying self-adhering labels, comprising:

a housing (1) provided with a handle (8) and having two side walls (2,3) consisting of sheet metal and held in spaced relation each side wall (2,3) comprises two parallel and free edges (14,15) which are opposite one another casing or sheathing walls (16,17) consisting of synthetic plastics and capable of being pushed over the outsides of each side wall (2,3), the said casing walls comprising flanges (18,19) which engage over the free edges (14,15) of the side walls (2,3)

and further comprising, arranged between said side walls (2,3)

a printing unit (5)

a withdrawal device for a carrier strip feeding the labels a deflecting device for the carrier strip a pressure-applying device (6) for the labels.

2. The apparatus of claim 1 wherein the two casing walls (16,17) are connected to one another to form a unit.

3. The apparatus of claim 1 wherein the casing walls (16,17) are capable of being fixed by means of at least one resilient latch (21) in the position for use of the apparatus.

4. A hand-held labelling apparatus for printing, dispensing and applying self-adhering labels, comprising:

a housing (1) provided with a handle (8) and having two side walls (2,3) consisting of sheet metal and held in spaced relation each side wall (2,3) comprises two parallel and free edges (14,15) which are opposite one another casing or sheathing walls (16,17) connected to one another to form a unit consisting of synthetic plastics and capable of being pushed over the outsides of each side wall (2,3) longitudinally of the apparatus, the said casing walls comprising flanges (18,19) which engage over the free edges (14,15) of the side walls (2,3)

and further comprising, arranged between said side walls (2,3)

a printing unit (5)

a withdrawal device for a carrier strip feeding the labels a deflecting device for the carrier strip a pressure-applying device (6) for the labels.

5. The apparatus of claim 4 wherein the casing walls (16,17) are connected to one another in one piece by a casing (20) enclosing the handle (8) connected fast to the housing (1).

6. The apparatus of claim 5 wherein the handle casing (20) includes lateral walls and an upper wall and is supported against the handle (8) by means of webs or fillets (31,32) formed at right angles on the lateral walls and upper wall.

7. A hand-held labelling apparatus for printing, dispensing and applying self-adhering labels, comprising:

a housing (1) provided with a handle (8) and having two side walls (2,3) consisting of sheet metal and held in spaced relation each side wall (2,3) comprises two parallel and free edges (14,15) which are opposite one another casing or sheathing walls (16,17) connected to one another to form a unit consisting of synthetic plastics and capable of being pushed over the outsides of each side wall (2,3) longitudinally of the apparatus, the said casing walls comprising flanges (18,19) which engage over the free edges (14,15) of the side walls (2,3) and wherein outwardly projecting, longitudinally extending fins (28) are arranged in the said side walls (2,3) and inwardly projecting, longitudinally extending beads (34) and arranged on the internal surfaces of the said casing walls (16,17)

and further comprising, arranged between said side walls (2,3)

a printing unit (5)

a withdrawal device for a carrier strip feeding the labels a deflecting device for the carrier strip a pressure-applying device (6) for the labels.

8. A hand-held labelling apparatus for printing, dispensing and applying self-adhering labels, comprising:

a housing (1) provided with a handle (8) and having two side walls (2,3) consisting of sheet metal and held in spaced relation each side wall (2,3) comprises two parallel and free edges (14,15) which are opposite one another casing or sheathing walls (16,17) connected to one another in one piece by a casing (20) enclosing the handle consisting of synthetic plastics and capable of being pushed over the outsides of each side wall (2,3) longitudinally of the apparatus, the said casing walls comprising flanges (18,19) which engage over the free edges (14,15) of the side walls (2,3) and wherein a fitting aperture (27) is arranged in at least one side wall (2 or 3) of the housing (1) and the casing walls (16,17) can be displaced on the side walls (2 or 3) up to a stop (33) in order to uncover the said aperture (27)

and further comprising, arranged between said side walls (2,3)

a printing unit (5)

a withdrawal device for a carrier strip feeding the labels a deflecting device for the carrier strip
a pressure-applying device (6) for the labels.

9. The apparatus of claim 8 wherein the stop (33) is arranged on the handle (8) connected fast to the housing (1) and, in the opening position of the casing walls (16,17), bears on the foremost fillet (31) of the handle casing (20).

10. A hand-held labelling apparatus for printing, dispensing and applying self-adhering labels, comprising:
a housing (1) provided with a handle (8) and having two side walls (2,3) consisting of sheet metal and held in spaced relation each side wall (2,3) comprises two parallel and free edges (14,15) which are opposite one another
casing or sheathing walls (16,17) connected to one another in one piece by a casing (20) enclosing the handle consisting of synthetic plastics and capable of being pushed over the outsides of each side wall (2,3) longitudinally of the apparatus, the said casing walls comprising flanges (18,19) which engage over the free edges (14,15) of the side walls (2,3) and wherein a resilient latch (21) is arranged on the forward end of the top of the handle casing (20) and cooperates with a latching stop (22) fixed on the housing for fixing the casing walls (16,17) in the position for use of the apparatus
and further comprising, arranged between said side walls (2,3)
a printing unit (5)
a withdrawal device for a carrier strip feeding the labels
a deflecting device for the carrier strip
a pressure-applying device (6) for the labels.

11. The apparatus of claim 10 wherein the rim of the said opening (24) is reinforced by a frame (25) which projects outwardly and is formed on the casing wall (17).

12. A hand-held labelling apparatus for printing, dispensing and applying self-adhering labels, comprising:
a housing (1) provided with a handle (8) and having two side walls (2,3) consisting of sheet metal and held in spaced relation each side wall (2,3) comprises two parallel and free edges (14,15) which are opposite one another
casing or sheathing walls (16,17) consisting of synthetic plastics and capable of being pushed over the outsides of each side wall (2,3), the said casing walls comprising flanges (18,19) which engage over the free edges (14,15) of the side walls (2,3)
and further comprising, arranged between said side walls (2,3)
a printing unit (5)
a withdrawal device for a carrier strip feeding the labels
a deflecting device for the carrier strip
a pressure-applying device (6) for the labels
the said withdrawal device includes a winding drum for the withdrawal of the carrier strip, which drum is mounted to be rotatable about a shaft (7) fixed on only one side wall (2) of the housing (1) and
a large recess (26) being arranged in the other side wall (3) of the housing (1) and a correspondingly large opening (24) for the extraction of the winding drum is arranged in the associated casing wall (17).

13. A hand-held labelling apparatus for printing, dispensing and applying self-adhering labels, comprising:
a housing (1) provided with a handle (8) and having two side walls (2,3) consisting of sheet metal and held in spaced relation each side wall (2,3) comprises two parallel and free edges (14,15) which are opposite one another
casing or sheathing walls (16,17) consisting of synthetic plastics and capable of being pushed over the outsides of each side wall (2,3), the said casing walls comprising flanges (18,19) which engage over the free edges (14,15) of the side walls (2,3) and wherein outwardly projecting, longitudinally extending fins (28) are arranged in the said side walls (2,3) and inwardly projecting, longitudinally extending beads (34) are arranged on the internal surfaces of the said casing walls (16,17)
and further comprising, arranged between said side walls (2,3)
a printing unit (5)
a withdrawal device for a carrier strip feeding the labels
a deflecting device for the carrier strip
a pressure-applying device (6) for the labels.

14. A hand-held labelling apparatus for printing, dispensing and applying self-adhering labels, comprising:
a housing (1) provided with a handle (8) and having two side walls (2,3) consisting of sheet metal and held in spaced relation each side wall (2,3) comprises two parallel and free edges (14,15) which are opposite one another
casing or sheathing walls (16,17) consisting of synthetic plastics and capable of being pushed over the outsides of each side walls (2,3), the said casing walls comprising flanges (18,19) which engage over the free edges (14,15) of the side walls (2,3) and wherein a fitting aperture (27) is arranged in at least one side wall (2 or 3) of the housing (1) and the casing walls (16,17) can be displaced on the side walls (2 or 3) up to a stop (33) in order to uncover the said aperture (27)
and further comprising, arranged between said side walls (2,3)
a printing unit (5)
a withdrawal device for a carrier strip feeding the labels
a deflecting device for the carrier strip
a pressure-applying device (6) for the labels.

* * * * *

UNITED STATES PATENT AND TRADEMARK OFFICE

CERTIFICATE OF CORRECTION

PATENT NO. : 4,288,276

DATED : September 8, 1981

INVENTOR(S) : Kurt Schrotz and Werner Becker

It is certified that error appears in the above-identified patent and that said Letters Patent are hereby corrected as shown below:

ON THE TITLE PAGE, PLEASE INSERT THE FOLLOWING:

[30] Foreign Application Priority Data

June 20, 1978 West Germany..... 28 26 991

Signed and Sealed this

*Nineteenth* Day of *January 1982*

[SEAL]

*Attest:*

GERALD J. MOSSINGHOFF

*Attesting Officer* *Commissioner of Patents and Trademarks*